US007258595B2

(12) United States Patent
Tada et al.

(10) Patent No.: US 7,258,595 B2
(45) Date of Patent: Aug. 21, 2007

(54) POLISHING APPARATUS

(75) Inventors: Mitsuo Tada, Kanagawa-ken (JP); Kazuo Shimizu, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 130 days.

(21) Appl. No.: 10/739,134

(22) Filed: Dec. 19, 2003

(65) Prior Publication Data

US 2004/0166773 A1 Aug. 26, 2004

(30) Foreign Application Priority Data

Dec. 20, 2002 (JP) ..... 2002-370858

(51) Int. Cl.
*B24B 19/00* (2006.01)

(52) U.S. Cl. ..... 451/5; 451/8; 451/9; 451/287; 451/398; 156/345.14; 156/345.28

(58) Field of Classification Search ..... 451/5, 451/8, 9, 41, 285, 287, 397, 398; 156/345.13, 156/345.14, 345.28
See application file for complete search history.

(56) References Cited

U.S. PATENT DOCUMENTS 6,280,291 B1 * 8/2001 Gromko et al. ..... 451/8
6,621,264 B1 9/2003 Lehman et al.
6,634,924 B1 10/2003 Ono et al.
6,699,791 B2 * 3/2004 Hofmann et al. ..... 438/692
6,709,314 B2 * 3/2004 Kaushal et al. ..... 451/8
6,811,466 B1 * 11/2004 Swedek et al. ..... 451/5
6,878,038 B2 * 4/2005 Johansson et al. ..... 451/6
6,951,624 B2 * 10/2005 Gotkis et al. ..... 216/86

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus comprises a polishing table having a polishing surface and a top ring for holding a substrate to be polished, in which the substrate when held by the top ring is pressed against the polishing surface of the polishing table and thus polished. A capacitance type sensor and/or an eddy-current type sensor is disposed at one or more location(s) in the vicinity of the top ring. The capacitance type sensor detects escaping of the substrate to be polished based on a change in capacitance between the capacitance type sensor and a top surface of the polishing table. The eddy-current type sensor detects escaping of the substrate to be polished based on a change in electrical resistance between the eddy-current type sensor and the top surface of the polishing table.

9 Claims, 8 Drawing Sheets

POLISHING APPARATUS

BACKGROUND OF THE INVENTION

The present invention relates to a polishing apparatus for polishing a workpiece to be polished, such as a semiconductor wafer and the like, and more specifically, to a polishing apparatus having a function of detecting an escaping/slipping-off of a workpiece from a workpiece holding mechanism during polishing.

In recent years, as a level of micro-miniaturization and high-integration of semiconductor device has progressed, a space between wirings has become much narrower. Especially, in photolithography with a line width equal to at most 0.5 μm, a shallow focal depth thereof requires a high level of flatness in a plane on which an exposing apparatus forms an image. To realize such high level of flatness, a polishing apparatus has been broadly employed to provide an effective polishing operation.

This type of polishing apparatus typically comprises a polishing turntable with a polishing cloth affixed on a top surface thereof, and a top ring body. The turntable and the top ring body are driven to rotate at independently determined revolving speeds. A substrate to be polished, which is held in the top ring body, is pressed against the polishing surface of the turntable. A surface of the substrate to be polished is polished into a flat and mirror-finished surface while supplying an abrasive liquid or slurry to the polishing surface. After this polishing operation is finished, the substrate to be polished is removed from the top ring body and transferred to a subsequent process, a cleaning process for example.

The polishing apparatus, however, has suffered from a problem in that the substrate to be polished is occasionally cracked during polishing, and fragments of this broken substrate are dispersed across the polishing cloth. If such a polishing cloth having the fragments of the broken substrate dispersed thereacross is reused, the polishing cloth could cause scratches on a surface of a substrate to be polished. Due to this, the polishing cloth has to be replaced with another each time a substrate to be polished is cracked.

There has been still another problem, even in a case of no cracking of a substrate to be polished, in that the substrate to be polished occasionally slips out of the top ring body. In this case, if the substrate to be polished is composed of fragile material as represented by a silicon wafer and the like, the substrate could impinge upon a wall surface of a casing covering a turntable and occasionally be damaged, such as by being chipped, in a peripheral region of the substrate to be polished. If this damaged substrate is to be polished again, only a light load applied to the vicinity of the damaged area could crack the substrate.

To address the above-mentioned problems, a polishing apparatus as disclosed in Japanese Patent Laid-open Publication No. 2001-96455 comprises a sensor of an ultrasonic type, which is disposed on an outside of a top ring to measure a distance to a top surface of a turntable. When the distance to the top surface of the turntable, which is measured by the sensor of the ultrasonic type, is changed due to intervening of a substrate to be polished that happens to slip out onto the surface of the turntable to be measured, the sensor detects this as an abnormal polishing or a slipping-off of the substrate to be polished.

Further, another polishing apparatus as disclosed in Japanese Patent Laid-open Publication No. 2001-96455 includes a condenser comprising electrode plates disposed to sandwich a substrate to be polished, which is held by a top ring, from both sides thereof. Alternatively, the polishing apparatus may include a condenser comprising electrode plates disposed in locations to sandwich a substrate to be polished which happens to slip out of the top ring. A constant voltage is applied to such a condenser, so that abnormal polishing or slipping-off of the substrate to be polished may be detected based on a current flowing through the condenser.

Still further, another polishing apparatus as disclosed in Japanese Patent Laid-open Publication No. 2001-96455 includes a contact element to be in contact with a turntable at a location defined on an under surface or a periphery of a top ring. A current is applied between this contact element and a turntable surface, so that abnormal polishing or slipping-off of the substrate to be polished may be detected based on a change in a current flowing therethrough.

However, either one of the above-described detection methods for determining abnormal polishing or slipping-off of a substrate to be polished has also suffered from a problem in that it is susceptible to effect of noise and the like, and thus is not reliable. In addition, any one of these methods has been associated with another problem in that it takes a long time to execute a signal processing and to finally determine whether or not this processed signal indicates abnormal polishing or slipping-off of a substrate to be polished, thereby disadvantageously leading to a state as allowing the substrate to be polished to impinge against, for example, a wall surface of a casing surrounding a turntable during waiting for an appropriate action, such as stopping of a top ring and/or the turntable, to be taken.

SUMMARY OF THE INVENTION

The present invention has been made in the light of the problems described above, and an object thereof is to provide a polishing apparatus capable of detecting an escaping or a slipping-off of a workpiece to be polished from a workpiece holding mechanism in a short time, and thus allowing for any appropriate action to be taken quickly.

According to an aspect of the present invention, there is provided a polishing apparatus comprising:

a polishing table having a polishing surface;

a workpiece holding mechanism for holding a workpiece to be polished, the workpiece when held by the workpiece holding mechanism being pressed against the polishing surface of the polishing table so that the workpiece is polished through a motion of the workpiece relative to the polishing surface of the polishing table; and at least one of a capacitance type sensor, an eddy-current type sensor, and a combination of the capacitance type sensor with the eddy-current type sensor being disposed in at least one location in a vicinity of a workpiece holding section of the workpiece holding mechanism, with the capacitance type sensor detecting an escaping of the workpiece to be polished based on a change in capacitance between the capacitance type sensor and a surface of the polishing table, and with the eddy-current type sensor detecting an escaping of the workpiece to be polished based on a change in electrical resistance between the eddy-current type sensor and the surface of the polishing table.

As described above, by employing such a configuration in which either one of the capacitance type sensor for detecting the escaping of the workpiece to be polished based on the change in the capacitance between the capacitance type sensor and the surface of the polishing table, the eddy-current type sensor for detecting the escaping of the workpiece to be polished based on the change in the electrical resistance between the eddy-current type sensor and the surface of the polishing table, or a combination of these two sensors is disposed in one or more location(s) in the vicinity of the workpiece holding section, escaping/slipping-off of the workpiece to be polished from the workpiece holding mechanism can be detected quickly (in a short time), as will be described later in detail.

DETAILED DESCRIPTION OF THE PREFERRED EMBODIMENTS

Figure 1A:
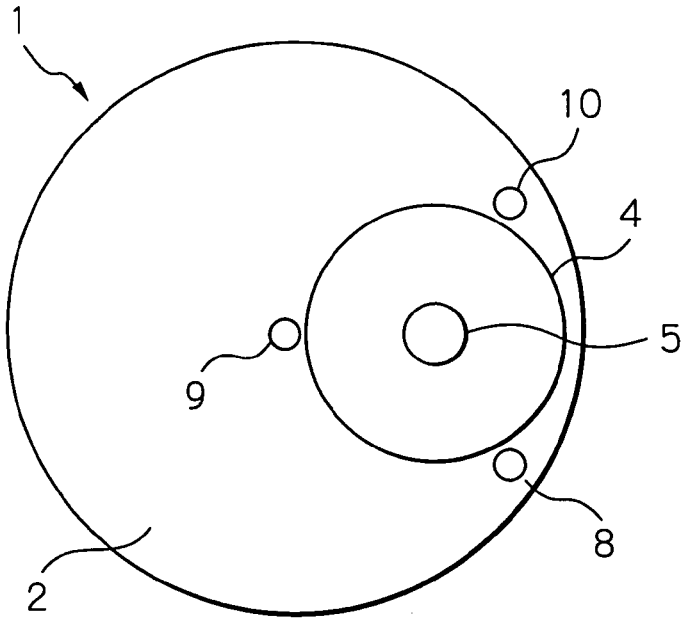
FIGS. 1(*a*) and 1(*b*) are schematic diagrams showing an exemplary general configuration of a polishing apparatus according to one embodiment of the present invention, wherein FIG. 1(*a*) is a plan view showing an arrangement of a top ring and a polishing table, while FIG. 1(*b*) is a side elevational view of the polishing apparatus.
Figure 1B:
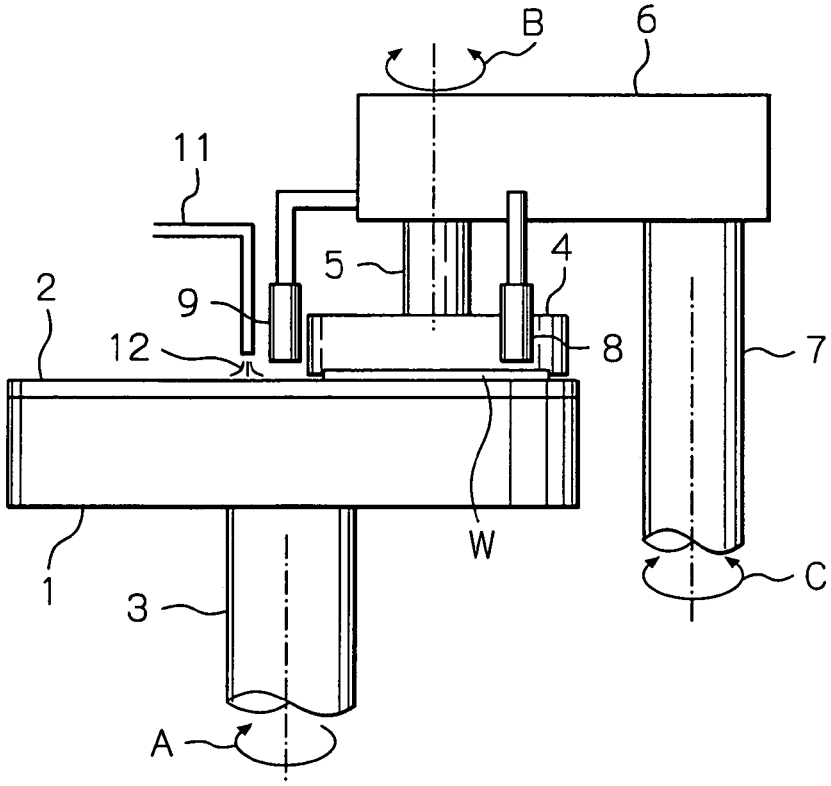

One embodiment of the present invention will now be described with reference to the attached drawings. FIGS. 1(*a*) and 1(*b*) are schematic diagrams showing an exemplary general configuration of a polishing apparatus according to one embodiment of the present invention. FIG. 1(*a*) is a plan view showing an arrangement of a top ring and a polishing table. FIG. 1(*b*) is a side elevational view of the polishing apparatus.

Referring to FIGS. 1(*a*) and 1(*b*), reference numeral 1 designates a polishing table (i.e., a turntable). A polishing cloth (a polishing pad) 2 is affixed onto a top surface of the polishing table 1. The polishing table 1 is supported by a revolving shaft 3. The polishing table 1 and the polishing cloth 2 are designed to be driven by the revolving shaft 3 so as to rotate in a direction indicated by an arrow A. Reference numeral 4 designates a top ring (i.e., a workpiece holding mechanism). The top ring 4 holds a substrate to be polished, W, such as a semiconductor wafer and the like, on its lower surface. The top ring 4 is mounted to a lower end of a top ring revolving shaft 5. The top ring revolving shaft 5 is operatively supported by a top ring swing arm 6 so as to rotate in a direction indicated by an arrow B. Further, the top ring 4 is adapted to move up and down along with the top ring revolving shaft 5 with respect to a polishing surface of the polishing table 1, namely the polishing cloth 2, by an elevator device, though not shown. A lowering operation of the elevator device moves down the top ring 4 to thereby cause the substrate to be polished, W, to be pressed against the polishing cloth 2 with a predetermined pressure applied thereon. Further, a lifting operation of the elevator device can move up the top ring 4 apart from the polishing cloth 2.

The top ring swing arm 6 is fixed to a swing shaft 7 and adapted to swing (rotate) by the swing shaft 7 in a direction indicated by an arrow C. Reference numerals 8, 9 and 10 individually designate sensors for detecting escaping/slipping-off of the substrate to be polished, W, which are disposed along a periphery of a workpiece holding section of the top ring 4. These sensors 8, 9 and 10 are mounted to the swing arm 6, respectively. Reference numeral 11 designates an abrasive liquid supply nozzle for supplying an abrasive liquid 12, such as a slurry, to a top surface of the polishing cloth 2 of the polishing table 1.

In the polishing apparatus having the configuration describe above, the substrate to be polished, W, which is held on the lower end surface of the top ring 4 rotating about the top ring revolving shaft 5, is pressed against the top surface (i.e., the polishing surface) of the polishing cloth 2 of the polishing table 1 rotating about the revolving shaft 3, and thus polished while supplying the abrasive liquid 12 from the abrasive liquid supply nozzle 11. During this polishing operation, if the substrate to be polished, W, escapes/slips out from the top ring 4, the substrate to be polished, W, would intrude into a space between a lower end of at least one of the sensors 8, 9 and 10 and the surface of the polishing cloth 2. In this event, the at least one of the sensors 8, 9 and 10 can detect the substrate.

Since the sensors 8, 9 and 10 serving for detecting the substrate to be polished, W, have been disposed in three locations along the periphery of the workpiece holding section of the top ring 4, either one of the sensors 8, 9 and 10 can detect the substrate to be polished, W, when it happens to escape/slip out from the workpiece holding section of the top ring 4 in any direction. In such a case where a direction of possible escaping/slipping-off of the substrate to be polished, W, may be estimated with high reliability to be a certain direction, for example, a downstream direction with respect to the top ring viewed from a rotational direction of the polishing table, then the sensor(s) may be disposed at one or more location(s) along the periphery in the direction.

The sensors 8, 9 and 10 may be capacitance type sensors. Alternatively, they may be eddy-current type sensors. Further alternatively, the sensors 8, 9 and 10 may be such sensors as fabricated by combining a capacitance type sensor with an eddy-current type sensor. This means that at least one of the sensors (e.g., the sensor 8) may be configured by combining the capacitance type sensor with the eddy-current type sensor, or one of the sensors (e.g., the sensor 8) may be configured by the capacitance type sensor while the other sensors (e.g., the sensors 9 and 10) may be configured by eddy-current type sensors.

Figure 2A:
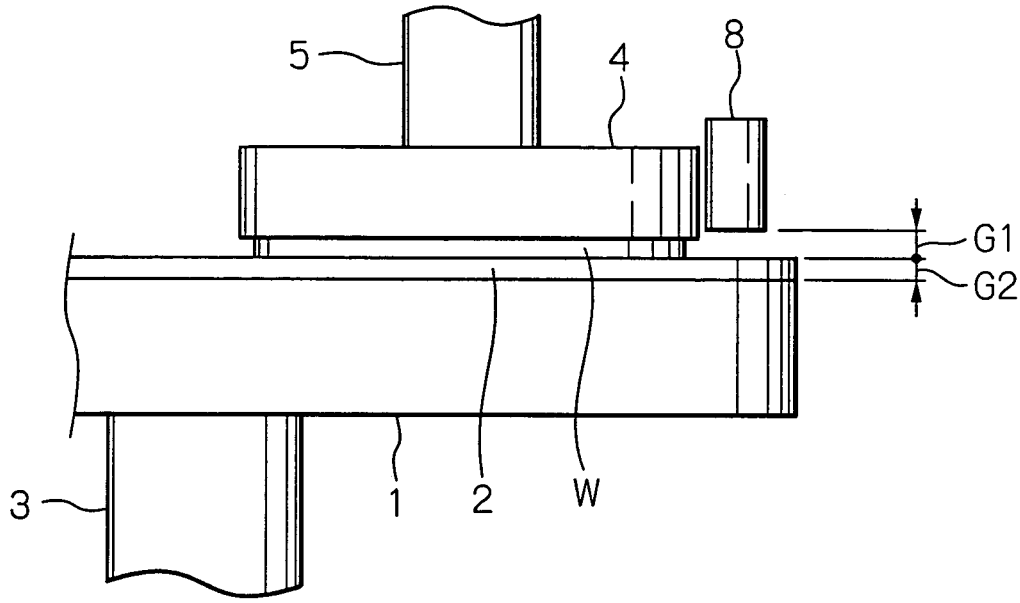
FIGS. 2(*a*) and 2(*b*) are schematic diagrams for illustrating a capacitance type sensor of the polishing apparatus according to one embodiment of the present invention, wherein FIG. 2(*a*) is a schematic view showing a state of a substrate to be polished, which is held normally on a lower surface of the top ring, while FIG. 2(*b*) is a schematic view showing a state of the substrate to be polished, which has partially escaped/slipped out from the lower surface of the top ring.
Figure 2B:
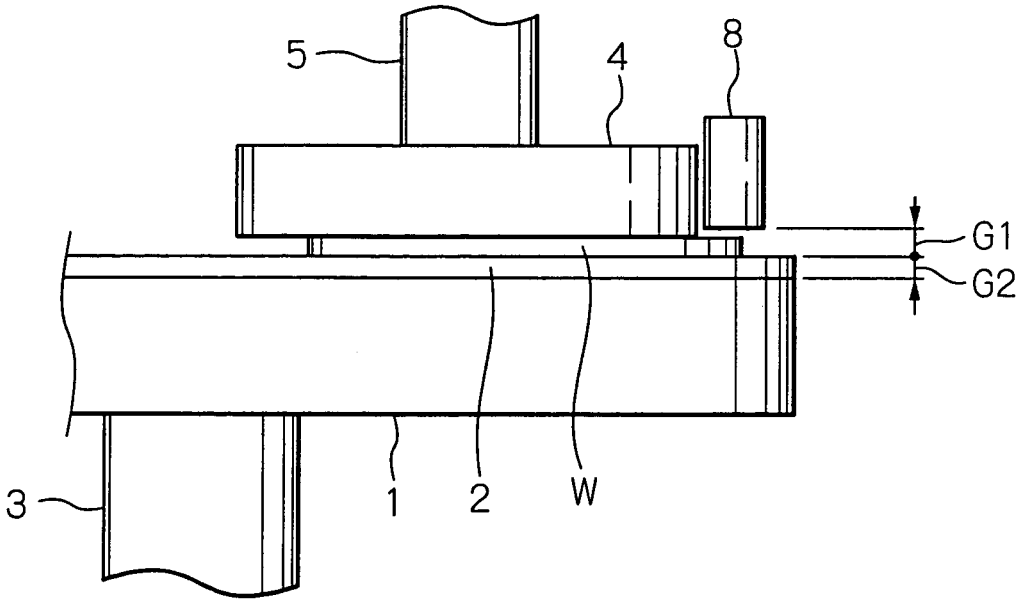

FIGS. 2(*a*) and 2(*b*) are schematic diagrams for illustrating an embodiment, in which each of the sensors 8, 9 and 10 has been configured as a capacitance type sensor. FIG. 2(*a*) shows a state of the substrate to be polished, W, which is held normally on the lower surface of the top ring 4. FIG. 2(*b*) shows a state of the substrate to be polished, W, which has partially escaped/slipped out from the lower surface of the top ring 4.

In a state where the substrate to be polished, W, is normally held on the lower surface of the top ring 4 as shown in FIG. 2(*a*), for example, the capacitance type sensor 8 measures a capacitance generated by a gap G1 between the lower surface of the sensor 8 and the top surface of the polishing cloth 2 and the thickness G2 of the polishing cloth 2. This measured value is expressed as a reference value Cr.

On the other hand, when the substrate to be polished, W, has partially escaped/slipped out from the lower surface of the top ring 4 and intruded into the gap G1 between the lower surface of the sensor 8 and the top surface of the polishing cloth 2 as shown in FIG. 2(*b*), the capacitance type sensor 8 measures a resultant capacitance Cc generated by the gap G1 between the lower surface of the sensor 8 and the top surface of the polishing cloth 2 and the thickness G2 of the polishing cloth 2.

A change ΔC in capacitance between the lower surface of the sensor 8 and the top surface of the polishing table 1 is defined by an expression, ΔC=Cc−Cr, allowing the escaping/slipping-off of the substrate to be polished, W, to be detected quickly (in a short time).

Figure 3:
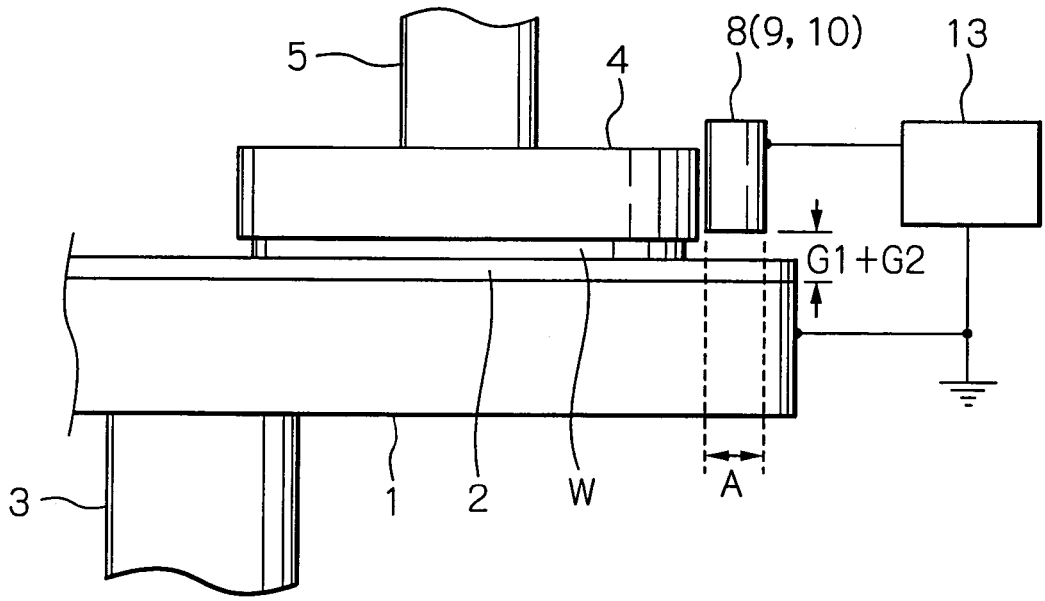
FIG. 3 is a schematic diagram showing a general configuration of a capacitance measuring system of the polishing apparatus according to one embodiment of the present invention.

FIG. 3 is a schematic diagram showing a general configuration of a capacitance measuring system for a case with each of the sensors 8, 9 and 10 configured as the capacitance type sensor.

Herein, an effective area of the sensor 8 is assumed to be A, a gap between the lower surface of the sensor 8 and the top surface of the polishing table 1 to be G1+G2, and a dielectric constant of a substance existing between the lower surface of the sensor 8 and the top surface of the polishing table 1 to be ∈. Since the gap between the lower surface of the sensor 8 and the top surface of the polishing table 1 yields G1+G2, capacitance between the lower surface of the sensor 8 and the polishing table 1 may be represented as:

$$C=(A\times\in)/(G1+G2)$$

This means that the capacitance C may be changed when the substrate to be polished, W, having a different dielectric constant ∈ from that of air intervenes between the lower surface of the sensor 8 and the polishing table 1. A control section 13 detects a change in this capacitance C and thus detects escaping of the substrate to be polished, W.

Figure 4:
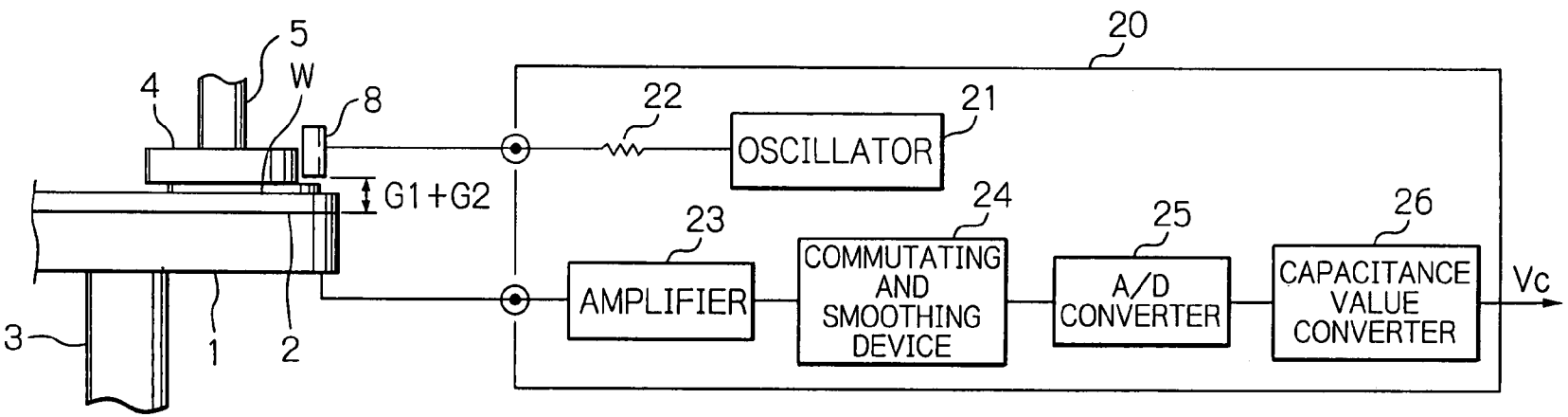
FIG. 4 is a block diagram showing an exemplary circuit design for detecting a change in capacitance by using the capacitance type sensor.

FIG. 4 is a block diagram for illustrating an exemplary circuit design for detecting a change in capacitance by using the capacitance type sensor 8.

A circuit for detecting the change in capacitance comprises a detecting section 20. The detecting section 20 comprises an oscillator (e.g., a crystal oscillator) 21, a resistor 22, an amplifier 23, a commutating and smoothing device 24, an A/D converter 25 and a capacitance value converter 26.

An oscillation signal (a high-frequency signal) from the oscillator 21 is supplied to the sensor 8, while a signal from the polishing table 1 is amplified by the amplifier 23 and converted by the commutating and smoothing device 24 into a direct current signal, which is further converted by the A/D converter 25 into a digital signal, and this obtained digital signal is in turn converted by the capacitance value converter 26 into an output voltage Vc which corresponds to a capacitance value. If capacitance C between the lower surface of the sensor 8 and the polishing table 1 is changed, a signal current flowing from the sensor 8 to the polishing table 1, and thus the output voltage Vc, are changed. Based on any change in this output voltage, escaping/slipping-off of the substrate to be polished, W, from the top ring 4 can be detected.

Figure 5A:
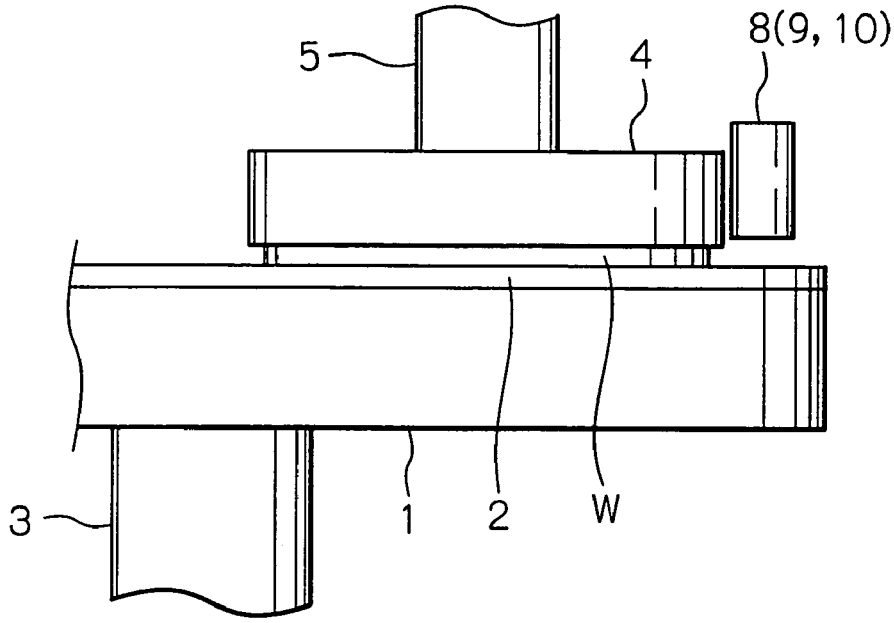
FIGS. 5(*a*) and 5(*b*) are schematic diagrams for illustrating an eddy-current type sensor of a polishing apparatus according to another embodiment of the present invention, wherein FIG. 5(*a*) is a schematic view showing a state of a substrate to be polished, which is held normally on a lower surface of a top sing, while FIG. 5(*b*) is a schematic view showing a state of the substrate to be polished, which has partially escaped/slipped out from the lower surface of the top ring.
Figure 5B:
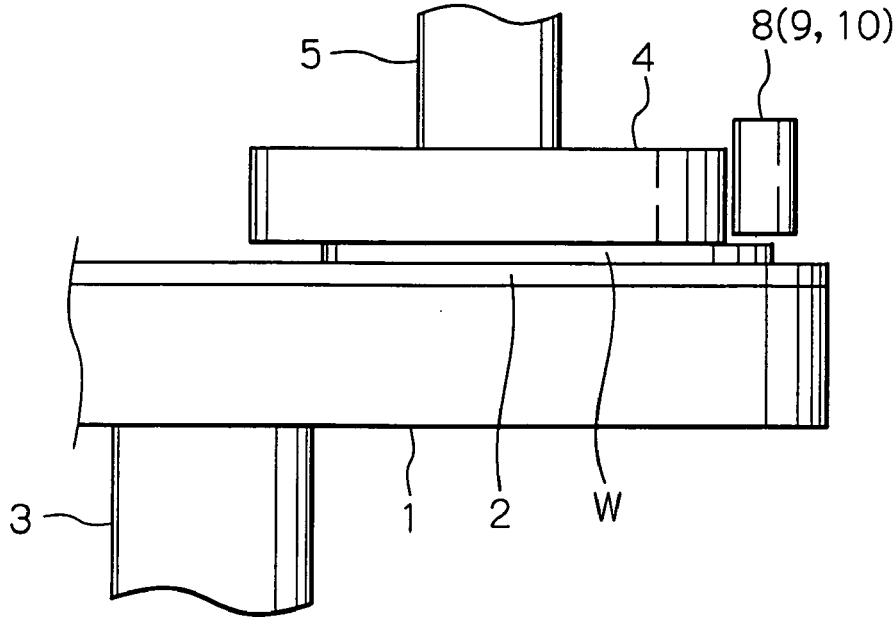

FIGS. 5(*a*) and 5(*b*) are schematic diagrams for illustrating another embodiment, in which each of the sensors 8, 9 and 10 has been configured as an eddy-current type sensor. Fi g. 5(*a*) shows a state of the substrate to be polished, W, which is held normally on the lower surface of the top ring 4. FIG. 5(*b*) shows a state of the substrate to be polished, W, which has partially escaped from the lower surface of the top ring 4.

In the state where the substrate to be polished, W, is normally held on the lower surface of the top ring 4 as shown in FIG. 5(*a*), for example, the eddy-current type sensor 8 measures an electrical resistance of the sensor 8 (i.e., the electrical resistance between the lower surface of the sensor and the polishing table). This measured value is expressed as a reference value Rr.

On the other hand, when the substrate to be polished, W, has partially escaped from the lower surface of the top ring 4 and intruded into a space between the lower surface of the sensor 8 and the top surface of the polishing cloth 2 as shown in FIG. 5(*b*), the eddy-current type sensor 8 measures the electrical resistance of the sensor 8. This measured value is represented by Rs. This measured value Rs and the reference value Rr are compared to each other to acquire the difference, ΔR=Rr−Rs, and thereby escaping of the substrate to be polished, W, can be detected quickly.

Figure 6:
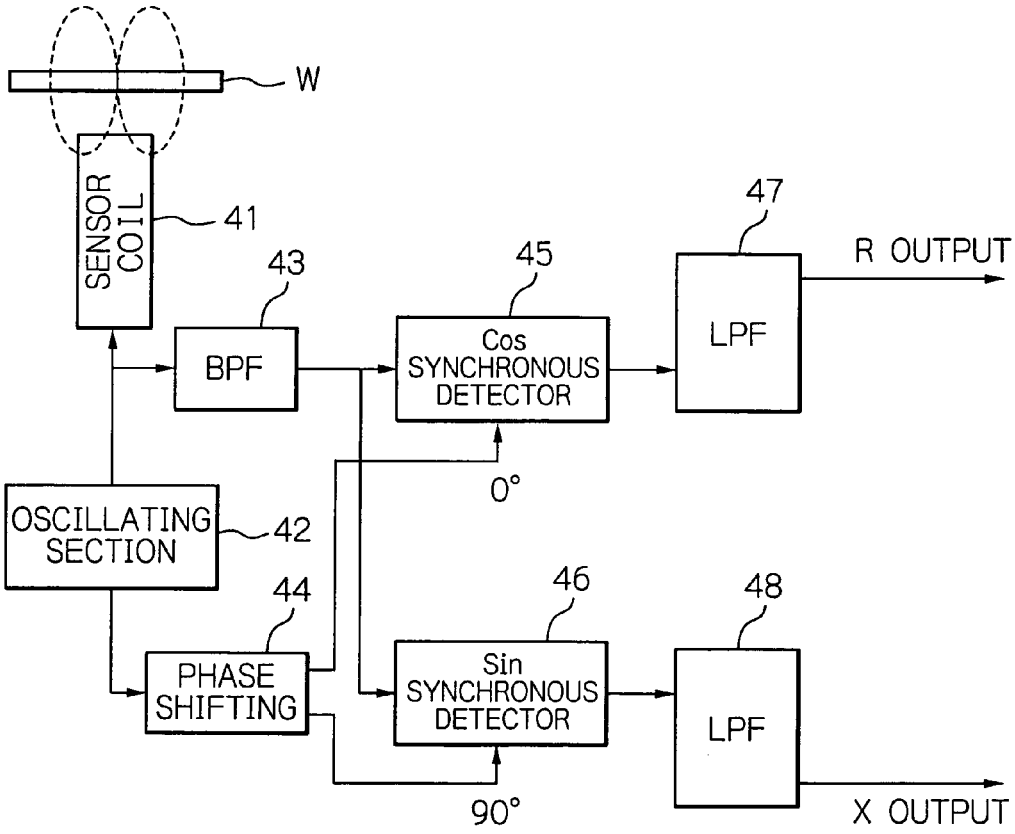
FIG. 6 is a block diagram showing an exemplary circuit design for detecting a resistance between a lower surface of the eddy-current type sensor and a top surface of a polishing table by using the eddy-current type sensor.

FIG. 6 is a block diagram for illustrating an exemplary circuit design for detecting a resistance value between the lower surface of the eddy-current type sensor 8 and the top surface of the polishing table by using the eddy-current type sensor 8.

The eddy-current type sensor 8 has a sensor coil 41. The sensor coil 41 is made up of an air core helical coil and disposed in the vicinity of the substrate to be polished, W.

A voltage detected between both ends of the sensor coil 41 passes through a band-pass filter 43 and then enters into a synchronous detecting section comprising a cos synchronous detector 45 and a sin synchronous detector 46. The cos synchronous detector 45 extracts a cos component of a detection signal from the voltage detected between both ends of the sensor coil 41. On the other hand, the sin synchronous detector 46 extracts a sin component of the detection signal from the voltage. An oscillation signal from an oscillating section 42 is formed into two signals, an in-phase component (0°) and an orthogonal component (90°), of a signal source by a phase shifting circuit 44. The signal of in-phase component (0°) is input to the cos synchronous detector 45 and the signal of the orthogonal component (90°) is input to the sin synchronous detector 46, and thus synchronous detection as described above is performed.

The signal that has experienced the synchronous detection is supplied to low-pass filters 47, 48 to remove any undesired high-frequency components containing higher frequencies than those of the signal components, so that ultimately resistance component (R) output representing the cos synchronous detection output and a reactance component (X) output representing the sin synchronous detection output are extracted, respectively. If the substrate to be polished, W, intrudes between the lower surface of the sensor 8 and the top surface of the polishing table 1, the resistance component (R) output and the reactance component (X) output are changed, so that escaping/slipping-off of the substrate to be polished, W, from the top ring 4 can be detected.

When the substrate to be polished, W, is made of insulating material, such as silicon, the eddy-current type sensor cannot detect whether or not the substrate to be polished, W, exists. In contrast to this, since the electrical resistance of the eddy-current type sensor 8 (i.e., the electrical resistance between the lower surface of the sensor and the polishing table 1) is measured and slipping-off of the substrate to be polished is detected based on the change in resistance, any escaping/slipping-off of the substrate to be polished, W, can be detected in a short time (within 1 msec). When the escaping/slipping-off of the substrate to be polished, W, is detected, an appropriate action can be taken, including that rotation of the top ring 4 and/or the polishing table 1 may be stopped, and/or that the top ring may be lifted up to separate the substrate to be polished, W, from the polishing surface.

Figure 7:
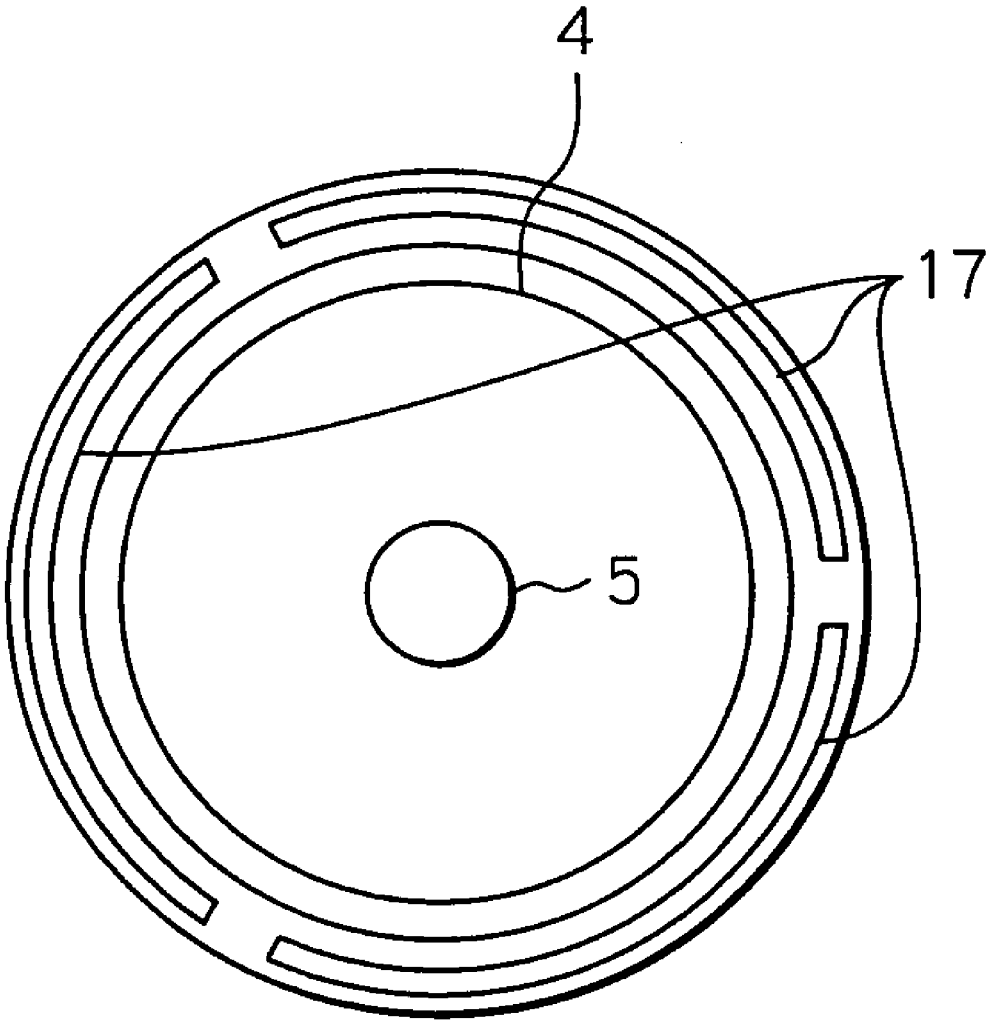
FIG. 7 is a schematic diagram showing an arrangement of a sensor electrode of a polishing apparatus according to still another embodiment of the present invention.

Although in the above embodiment has been illustrated by way of example a case where the capacitance type or the eddy-current type sensors 8, 9 and 10 have been disposed in a plurality of locations (three locations in FIG. 1) surrounding the top ring 4, the present invention is not limited to this configuration. In an alternative embodiment, electrode(s) 17 of the sensor may be formed into a circular arc shape as shown in FIG. 7, wherein each electrode 17 may be disposed along a periphery of the top ring 4. This enables the substrate to be polished, W, if escaping/slipping-off from anywhere, to be detected without using a plurality of capacitance type or eddy-current type sensors.

With an abnormality detection signal of the substrate to be polished, such as a silicon wafer and the like, supplied by a current sensor or the like according to the related art, good stability and repeatability of the signal cannot be achieved without applying an averaging or a moving averaging processing to the signal. In a case where the averaging or the moving averaging processing is applied, a possible delay time may reach 3.6 sec in maximum, resulting in too late detection of an abnormality to prevent the substrate to be polished, W, from slipping out of the top ring 4. In a case where the eddy-current type sensor is employed as the sensor 8, by detecting which one of the resistance component (R) output or the reactance component (X) output has become greater than a normal level, as described above, it is possible to detect the escaping/slipping-off of the substrate to be polished, W, from the top ring 4. A necessary detection time in that case will be within 10 msec.

Figure 8:
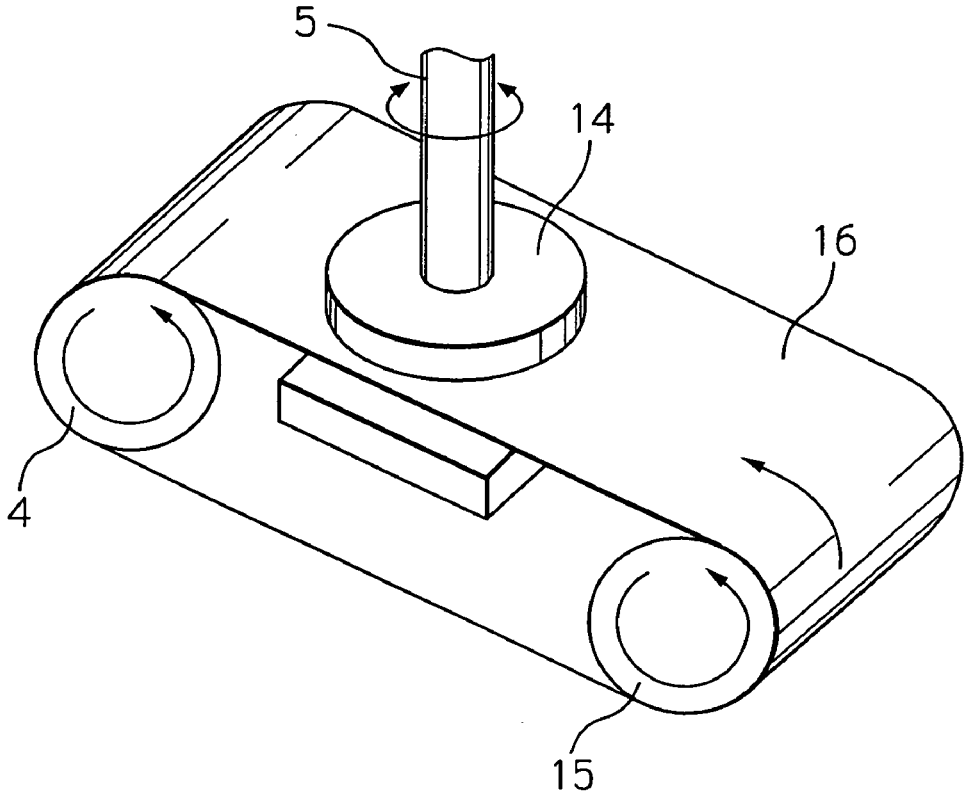
FIG. 8 is a schematic perspective view showing a general configuration of a polishing apparatus according to yet still another embodiment of the present invention.

It is to be noted that although the above embodiment has been described for a case of a polishing table represented by a turntable, the polishing table is not limited to this, and it may be such a polishing table as shown in FIG. 8 comprising a polishing pad 16 in a form of an endless belt bridging across a driven roller 4 and a driving roller 15, in which rotation of the driving roller 15 may cause the polishing pad 16 to move. Alternatively, the polishing table may be a table of a scroll (translational circulation) movement type, which is not allowed to rotate around its own axis but is revolved with a small radius, or may be a table of a type of controllable rotation and revolution, in which a rotating speed and a revolving speed can be controlled independently from each other.

It is to be noted that although the above embodiments have been described for an example employing the capacitance type sensor or the eddy-current type sensor, or the combination thereof as the sensor, it is a matter of course that the sensor may be configured with the capacitance type or the eddy-current type sensor in combination with an ultrasonic-type sensor for example, or may be configured with all of these types of sensors in combination.

Although in the above embodiments, the polishing pad has been used as the polishing surface, a bonded abrasive (a grinding stone or a pad) composed of abrasive grains that have been bonded with binder may be employed. In that case, water (purified water) or a chemical solution comprising a surfactant may be used. The chemical solution is used in order to appropriately adjust an autogenous amount of the abrasive grains and/or a polishing rate of the substrate, and may be supplied to the polishing surface as an abrasive liquid.

According to the above embodiments, owing to the configuration in which a set of sensor(s) comprising either one or both in combination of the capacitance type sensor that detects escaping of a workpiece to be polished based on a change in capacitance between the sensor and the top surface of the polishing table, and an eddy-current type sensor that detects escaping of a workpiece to be polished based on a change in electrical resistance between the sensor and the top surface of the polishing table, disposed at one or more location(s) in the vicinity of a workpiece holding section, escaping/slipping-off of the workpiece to be polished from the workpiece holding mechanism can be detected quickly (in a short time).

In addition, owing to the configuration in which the capacitance type sensor and/or the eddy-current type sensor are (is) mounted to a swing arm, escaping of the workpiece to be polished can be detected quickly even during a swinging motion of the workpiece holding mechanism.

Further, owing to the configuration in which the capacitance type or the eddy-current type sensor comprising one or more sensor electrode(s) having a generally circular arc shape is disposed along a periphery of the vicinity of a workpiece holding section of the workpiece holding mechanism, escaping of a workpiece to be polished from a broad extent can be detected quickly.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The entire disclosure of Japanese Patent Application No. 2002-370858 filed on Dec. 20, 2002 including specification, claim, drawings and summary is incorporated herein by reference in its entirety.

What is claimed is:

1. A polishing apparatus comprising:

a polishing table having a polishing surface;

a workpiece holding mechanism for holding a workpiece to be polished, such that when the workpiece is held by said workpiece holding mechanism and pressed against said polishing surface the workpiece is polished through motion of the workpiece relative to said polishing surface; and an eddy-current type sensor, having a sensor coil, in one location in a vicinity of a workpiece holding section of said workpiece holding mechanism, said eddy-current type sensor for measuring an electrical resistance and an electrical reactance between said eddy-current type sensor and a surface of said polishing table to detect escaping of the workpiece when a value of the electrical resistance or electrical reactance between said eddy-current type sensor and the surface of said polishing table, as measured by said eddy-current type sensor, is greater than a predetermined value.

2. The polishing apparatus according to claim 1, further comprising:

a swing arm swingably supporting said workpiece holding mechanism.

3. The polishing apparatus according to claim 2, wherein said eddy-current type sensor is in the form of at least one sensor electrode having a generally circular arc shape, with said at least one sensor electrode being disposed along a periphery of the vicinity of said workpiece holding section of said workpiece holding mechanism.

4. The polishing apparatus according to claim 1, wherein said eddy-current type sensor is in the form of at least one sensor electrode having a generally circular arc shape, with said at least one sensor electrode being disposed along a periphery of the vicinity of said workpiece holding section of said workpiece holding mechanism.

5. A polishing apparatus comprising:

a polishing table having a polishing surface;

a workpiece holding mechanism for holding a workpiece to be polished;

a positioning device for positioning said workpiece holding mechanism relative to said polishing surface such that the workpiece, while held by said workpiece holding mechanism, can be pressed against said polishing surface;

a relative motion generating device for generating relative motion between the workpiece, while held by said workpiece holding mechanism, and said polishing surface so as to polish the workpiece when pressed against said polishing surface; and a detecting arrangement for detecting escaping of the workpiece from said workpiece holding mechanism, said detecting arrangement including (a) an eddy-current type sensor having a sensor coil, said eddy-current type sensor for measuring an electrical resistance and an electrical reactance between said eddy-current type sensor and a surface of said polishing table, and (b) a control section for detecting escaping of the workpiece from said workpiece holding mechanism when a value of the electrical resistance or electrical reactance between said eddy-current type sensor and a surface of said polishing table, as measured by said eddy-current type sensor, is greater than a predetermined value.

6. The polishing apparatus according to claim 5, wherein said eddy-current type sensor is in one location in a vicinity of a workpiece holding section of said workpiece holding mechanism.

7. The polishing apparatus according to claim 5, further comprising:

a swing arm swingably supporting said workpiece holding mechanism.

8. The polishing apparatus according to claim 5, wherein said eddy-current type sensor is in the form of at least one sensor electrode having a generally circular arc shape, with said at least one sensor electrode being disposed along a periphery of a vicinity of a workpiece holding section of said workpiece holding mechanism.

9. A polishing apparatus comprising:

a polishing table having a polishing surface;

a workpiece holding mechanism for holding a workpiece to be polished, such that when the workpiece is held by said workpiece holding mechanism and pressed against said polishing surface the workpiece is polished through motion of the workpiece relative to said polishing surface; and an eddy-current type sensor, having a sensor coil, in one location in a vicinity of a workpiece holding section of said workpiece holding mechanism, said eddy-current type sensor for measuring an electrical resistance and an electrical reactance between said eddy-current type sensor and a surface of said polishing table to detect escaping of the workpiece when a value of the electrical resistance or electrical reactance between said eddy-current type sensor and the surface of said polishing table, as measured by said eddy-current type sensor, is greater than a predetermined value.

* * * * *